US009492050B2

(12) United States Patent
Filho et al.

(10) Patent No.: US 9,492,050 B2
(45) **Date of Patent: *Nov. 15, 2016**

(54) TEXTURED DEVICE FOR CLEANING COSMETIC BRUSHES

(71) Applicant: Sigma Enterprises, LLC, New Brighton, MN (US)

(72) Inventors: Rene Xavier Filho, Fort Lauderdale, FL (US); Simone Rodrigues Oliveira Xavier, Fort Lauderdale, FL (US)

(73) Assignee: Sigma Enterprises, LLC, New Brighton, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/980,956

(22) Filed: Dec. 28, 2015

(65) Prior Publication Data

US 2016/0113387 A1 Apr. 28, 2016

Related U.S. Application Data

(63) Continuation of application No. 14/296,100, filed on Jun. 4, 2014, now Pat. No. 9,345,379, which is a continuation of application No. 13/540,090, filed on Jul. 2, 2012, now Pat. No. 9,015,895.

(51) Int. Cl.

| | |
|---|---|
| ***A46B 17/06*** | (2006.01) |
| ***A47L 13/18*** | (2006.01) |
| ***A46B 5/04*** | (2006.01) |

(52) U.S. Cl.

CPC ..... *A47L 13/18* (2013.01); *A46B 5/04* (2013.01); *A46B 17/06* (2013.01); *A46B 2200/1046* (2013.01)

(58) Field of Classification Search

CPC ..... A46B 17/06; A47L 13/18

See application file for complete search history.

(56) References Cited

U.S. PATENT DOCUMENTS

| | | | |
|---|---|---|---|
| 61,841 | A | 2/1867 | Lewis |
| 1,209,763 | A | 12/1916 | Rosengren |
| 1,279,855 | A | 9/1918 | Garvey |
| 1,559,114 | A | 10/1925 | Maranville |
| 1,657,784 | A | 1/1928 | Bergstrom |
| 1,782,502 | A | 11/1930 | Crane |
| 1,877,527 | A | 9/1932 | Moran |
| 1,884,659 | A | 10/1932 | Gould |
| 1,885,572 | A | 11/1932 | Wood |
| 1,979,130 | A | 10/1934 | Wiley |

(Continued)

FOREIGN PATENT DOCUMENTS

| | | | |
|---|---|---|---|
| CN | 2448274 | Y | 9/2001 |
| CN | 2868178 | Y | 2/2007 |

(Continued)

OTHER PUBLICATIONS

Plaintiff, Prior Art Statement (Litigation Document, U.S. Pat. No. 9,015,895), dated Apr. 13, 2016.

(Continued)

*Primary Examiner* — Randall Chin

(74) *Attorney, Agent, or Firm* — Dorsey & Whitney LLP

(57) ABSTRACT

A cosmetic brush cleaning device includes an enclosure for receiving the user's hand and incorporates washing and rinsing textures suited to cosmetic brushes. One version of the device features a primary section, and two thumb sections emanating from opposite sides of the primary section.

20 Claims, 9 Drawing Sheets

(56) References Cited

U.S. PATENT DOCUMENTS

| | | | |
|---|---|---|---|
| 2,187,430 | A | 1/1940 | Olmsted et al. |
| D132,564 | S | 5/1942 | Lindfelt |
| 2,325,903 | A | 8/1943 | Blair et al. |
| 2,880,436 | A | 4/1959 | Hayden |
| 3,255,462 | A | 6/1966 | Antonious |
| 3,513,061 | A | 5/1970 | Vinicki |
| 4,154,883 | A | 5/1979 | Elias |
| D256,181 | S | 8/1980 | Kupperman et al. |
| D268,968 | S | 5/1983 | Sami |
| D270,582 | S | 9/1983 | Pietrocola |
| 4,494,267 | A | 1/1985 | Fredley |
| 4,621,388 | A | 11/1986 | Ortolivo |
| 4,980,943 | A | 1/1991 | Barber |
| 5,022,093 | A | 6/1991 | Hall |
| D326,750 | S | 6/1992 | Druzek |
| 5,322,056 | A | 6/1994 | Menghi et al. |
| 5,441,355 | A | 8/1995 | Moore |
| D363,577 | S | 10/1995 | Brightbill et al. |
| D363,606 | S | 10/1995 | Abrahamson |
| 5,687,444 | A | 11/1997 | Hakker |
| 5,898,942 | A | 5/1999 | Anderson |
| 6,018,837 | A | 2/2000 | Andreu |
| 6,058,882 | A | 5/2000 | Leutholt |
| D429,860 | S | 8/2000 | Denney |
| D439,386 | S | 3/2001 | Denney |
| 6,264,391 | B1 | 7/2001 | Kroha |
| D446,616 | S | 8/2001 | Denney |
| 6,460,190 | B1 | 10/2002 | Blum |
| 6,560,813 | B2 | 5/2003 | Brown et al. |
| 6,581,211 | B1 | 6/2003 | Golden |
| D477,690 | S | 7/2003 | Howell et al. |
| 6,669,657 | B1 | 12/2003 | Ongwela |
| D492,816 | S | 7/2004 | Bergquist et al. |
| 6,811,338 | B1 | 11/2004 | Manske, Jr. et al. |
| D514,765 | S | 2/2006 | Dretzka |
| D517,753 | S | 3/2006 | Northrop |
| D523,192 | S | 6/2006 | Northrop |
| D526,096 | S | 8/2006 | Kaposi |
| D528,251 | S | 9/2006 | Lion et al. |
| 7,117,536 | B2 | 10/2006 | Burnett et al. |
| RE39,388 | E | 11/2006 | DeBartolo |
| D537,997 | S | 3/2007 | Plikuhn |
| 7,210,171 | B2 | 5/2007 | Jacobs et al. |
| D544,665 | S | 6/2007 | Keene |
| 7,234,170 | B2 | 6/2007 | Simic |
| D554,331 | S | 11/2007 | Matis |
| D556,967 | S | 12/2007 | Martins et al. |
| D560,048 | S | 1/2008 | Snell |
| D569,578 | S | 5/2008 | Yan |
| D581,120 | S | 11/2008 | Sofy et al. |
| D610,753 | S | 2/2010 | Moskowitz |
| 7,681,250 | B2 | 3/2010 | Friedstrom |
| 7,707,654 | B1 | 5/2010 | Spence |
| D625,482 | S | 10/2010 | Yang et al. |
| 7,823,245 | B2 | 11/2010 | Firouzman |
| D650,522 | S | 12/2011 | Gundersen |
| D651,408 | S | 1/2012 | Farkas |
| D662,292 | S | 6/2012 | Meynard |
| D667,187 | S | 9/2012 | Sowinski et al. |
| 8,356,378 | B1 | 1/2013 | Crooms |
| 8,371,044 | B2 | 2/2013 | Rusnak |
| D685,560 | S | 7/2013 | Lee et al. |
| D687,623 | S | 8/2013 | Norris |
| 8,677,544 | B1 | 3/2014 | Raven et al. |
| D703,409 | S | 4/2014 | Robins, III et al. |
| 8,689,387 | B2 | 4/2014 | Gundersen |
| D707,005 | S | 6/2014 | Levy et al. |
| 9,015,895 | B2 | 4/2015 | Filho et al. |
| 2005/0166301 | A1 | 8/2005 | Tweel et al. |
| 2005/0177965 | A1 | 8/2005 | Edoh |
| 2006/0191092 | A1 | 8/2006 | O'Reilly et al. |
| 2006/0272116 | A1 | 12/2006 | Thompson |
| 2007/0048063 | A1 | 3/2007 | Bauer et al. |
| 2007/0118963 | A1 | 5/2007 | Snyder |
| 2007/0277288 | A1 | 12/2007 | Sing et al. |
| 2008/0109933 | A1 | 5/2008 | Dolenak |
| 2008/0178366 | A1 | 7/2008 | Daher |
| 2008/0244848 | A1 | 10/2008 | Firouzman |
| 2008/0283078 | A1 | 11/2008 | Dumler et al. |
| 2009/0139007 | A1 | 6/2009 | Bevier |
| 2010/0192318 | A1 | 8/2010 | Huizinga |
| 2010/0218326 | A1 | 9/2010 | Yamaguchi |
| 2012/0023693 | A1 | 2/2012 | Pung et al. |
| 2012/0060312 | A1 | 3/2012 | Kubes |
| 2014/0000052 | A1 | 1/2014 | Filho et al. |
| 2014/0289987 | A1 | 10/2014 | Filho et al. |

FOREIGN PATENT DOCUMENTS

| | | | |
|---|---|---|---|
| CN | 201441347 | U | 4/2010 |
| CN | 101856156 | A | 10/2010 |
| DE | 20102840 | U1 | 6/2001 |
| KR | 200422216 | Y1 | 7/2006 |
| SE | 62075-0001 | | 11/1997 |
| WO | WO 02/01997 | A2 | 1/2002 |
| WO | WO2011067677 | A2 | 6/2011 |

OTHER PUBLICATIONS

Plaintiff, Opening Claim Chart (Litigation Document, U.S. Pat. No. 9,015,895), dated Feb. 26, 2016.

Defendants, Prior Art Statement (Litigation Document, U.S. Pat. No. 9,015,895), dated Mar. 18, 2016.

Defendants, Responsive Claim Chart (Litigation Document, U.S. Pat. No. 9,015,895), dated Mar. 18, 2016.

The extended European Search Report dated Sep. 11, 2015 in connection with European Patent Application No. 14197771.0.

The extended European Search Report dated Sep. 11, 2015 in connection with European Patent Application No. 14197802.3.

"2X Sigma Spa® Brush Cleaning Glove." Retrieved Dec. 14, 2015 from <https://web.archive.org/ web/20140529021235/http://www.sigmabeauty.com/2X_Sigma_Spa_Brush_Cleaning_glove_p/ssg2x.htm>.

"Sigma Spa™ Brush Cleaning Glove." Retrieved Dec. 14, 2015 from <https://web.archive.org/web/20130220234830/http://www.sigmabeauty.com/Sigma_Spa_Brush_Cleaning_glove_p/bc001.htm?>.

My Makeup Issues. "Sigma Spa Brush Cleaning Glove—Review." Mar. 13, 2013 Retrieved Dec. 14, 2015 from <http://mymakeupissues.blogspot.com/2013/03/sigma-spa-brush-cleaning-glove-review.html>.

The extended European Search Report dated Oct. 22, 2015 in connection with European Patent Application No. 15170663.7.

Samanta: "New! Sigma 2X Spa Glove; the other end of the brush", May 29, 2014. Retrieved Oct. 13, 2015 from <https://theotherendofthebrush.wordpress.com/2014/05/29/new-sigma-2x-spa-glove-2/>.

Dulce Candy: "Review/Demo: 2X Sigma Spa Brush Cleaning Glove", Jun. 17, 2014. Retrieved 10, 14, 2015 from <https://www.youtube.com/watch?v=1x04MrHPkrQ>.

Amazon.com: Norpro Pink Silicone and Fabric Glove, Medium, from Norpro. retrieved Oct. 14, 2015 from <http://www.amazon.com/gp/product/B001FB59OA?keywords=norpro%20glove&qid=1444835721&ref_=sr_1_1&sr=8-1>.

Norpro—Quality for the Cook. retrieved Oct. 14, 2015 from <https://we.archive.org/web/20090503194212/http://www.norpro.com/store/products/siliconefabric-oven-glove-pink>.

Norpro—Quality for the Cook. retrieved Oct. 14, 2015 from <https://we.archive.org/web/20121124064626/http://www.norpro.com/store/products/siliconefabric-oven-glove-pink>.

Office Action dated May 11, 2015 received in connection with Chinese Application No. 201310063907.8, including English translation.

Target Mobile Site—Silicone Solutions Black Silicone Oven Mitt. <http://sites.target.com/site/en/spot/mobile_product_detail.jsp?tcin=568859&keywords=sili . . . Feb. 28, 2012.

Makeup Brush Washing Instructions: How & Why Clean Your Dirty Cosmetic Brushes. <http://www.freebeautytips.org/cleanbrushes_html> Apr. 2, 2012.

(56) References Cited

OTHER PUBLICATIONS

How to Clean Makeup Brushes Video and Steps. <http://www.realsimple.com/beauty-fashion/makeup/how-to-clean-makeup-brushes-0000000 Apr. 3, 2012.

How to Clean Makeup Brushes/Cleaning Guides. <http://www.howtocleanstuff.net/how-to-clean-makeup-brushes/ Apr. 2, 2012.

"Brushegg: A Compact Makeup Brush Cleaning Tool," Coffee Sundays, Article Dec. 18, 2014, retrieved Jul. 8, 2016 from <http://www.coffeesundays.com/2014/12/18/brushegg-a-compact-makeup-brush-cleaning-tool/>, 14 pages.

"Dog Grooming: Rinse Ace Bath Mitt at Drs. Foster & Smith," Review Apr. 10, 2011, retrieved Jul. 7, 2016 from <http://www.drsfostersmith.com/product/prod_display.cfm?pcatid=11101>, 4 pages.

"Makeup Brush Cleaning!" Rebekah Elizabeth, website copyright 2015, retrieved Jul. 8, 2016 from <http://rebekaheliz.com/2013/05/29/makeup-brush-cleaning/>, 5 pages.

PECO Ignores Pottstown too?, post date Jul. 1, 2010, <http://www.saveardmorecoalition.org/node/4731/peco-ignores-pottstown-too>, site visited Jul. 15, 2016, 9:57:06 PM.

TEXTURED DEVICE FOR CLEANING COSMETIC BRUSHES

CROSS-REFERENCE TO RELATED APPLICATIONS

This application is a continuation of U.S. patent application Ser. No. 14/296,100, filed Jun. 4, 2014, issued May 24, 2016 as U.S. Pat. No. 9,345,379, which is a continuation-in-part of U.S. patent application Ser. No. 13/540,090, filed Jul. 2, 2012, issued Apr. 28, 2015 as U.S. Pat. No. 9,015,895, each of which is incorporated by reference herein, in the entirety and for all purposes.

BACKGROUND

The present invention relates to cleaning implements supported by hand, and more particularly to specially textured cleaning devices shaped like a mitten or glove to be worn on the hand when used.

Over the years, devices intended for a variety of uses have been formed in the shape of a glove or mitten. This allows the devices to be worn on the hand, eliminating the need to grip, balance or otherwise consciously support them, permitting the user to direct more attention to the task at hand. A device worn by hand can be specially textured over areas that correspond to a selected part of the hand particularly well suited to the purpose of the device, e.g. the palm or fingers. For example, U.S. Pat. No. 7,823,245 (Firouzman), U.S. Pat. No. 6,018,837 (Andreu), and published U.S. patent application (Publication No. 2012/0218326 to Yamaguchi) disclose cleaning gloves with surfaces including abrasive material for scouring, along with sponge or other water absorbent material. Another published application (Publication No. 2007/027728 to Sing) discloses a cleaning glove with a palm patch of cleaning material that can include bristles, wire, a roughened polymer or sandpaper.

U.S. Pat. No. 7,707,654 (Spence) discloses a massage glove including a latex body and pads formed with resilient members and beads.

U.S. Pat. No. 7,234,170 (Simic) discloses a protective hand covering in the shape of a mitten with nodules extending from both the exterior surface and the interior surface of the mitten. The inner and outer nodules are offset from one another, which is said to more effectively protect the hand against extreme temperatures when the mitten is used to grip hot or cold objects. U.S. Design Pat. No. D526,096 (Kaposi) illustrates a silicone glove with rounded nodules formed over the front and back exterior surfaces of a mitten shaped body.

Thus, glove-shaped and mitten-shaped devices, worn by hand, can have specialized surface textures to enhance a variety of functions performed by hand, and to afford protection to the user's hand when necessary or desired.

Users of cosmetic brushes are advised to clean their brushes frequently, both to enhance subsequent applications of makeup and extend the useful lives of the brushes. Frequent and proper cleaning avoids the accumulation of old makeup, skin oils and bacteria. These accumulations can undesirably affect the color of later applied makeup due to oxidation or binding with skin oils, and they may lead to skin problems or eye infections.

Cosmetic brushes frequently are cleaned by hand, applying a mixture of water and mild soap or shampoo to the bristles as the bristles are worked against the palm of the hand to expose as much bristle surface area as possible to the liquid mixture. This is followed by rinsing, typically working the bristles with the fingers while holding the bristles under running water. Typically, several repetitions of the washing and rinsing steps are necessary before clear water at the rinsing stage indicates sufficient cleaning.

Efforts to improve upon the results afforded by hand washing have led to products with textured surfaces intended to enhance wiping action along the bristles as a cosmetic brush is washed. For example, a product marketed as the Wildflower Makeup Brush Scrub Tub features a tub with a lid that contains an embossed wildflower grid. The grid is said to remove the cakey, waxy substances left by cosmetics when the wet, soaped brush is moved in a circular fashion or back and forth against the grid. Similarly, a product known as the Parian Brush Cleaning Refill Jar is provided with a plastic sifter in the form of a rectangular grid to help clean brushes.

Although these products enhance brush cleaning through improved wiping action against the bristles, they must be held or gripped by hand, or maintained by hand against a flat surface, while the user manipulates the brush relative to the textured surface of the grid. These products feature a single grid with a single texture. There is no tailoring of the texture to suit larger brushes as opposed to smaller brushes, or to individually address the disparate needs of the washing stage and the rinsing stages. These products, whether considered alone or in combination with hand washing and rinsing, fail to address the need to remove excess moisture following cleaning.

Accordingly the present invention has several aspects, each directed to one or more of the following objects:

- to provide a cosmetic brush cleaning device with a variety of surface textures tailored for washing and rinsing both larger and smaller brushes;
- to provide a cosmetic brush cleaning device usable in a manner that replicates natural movement and placement of the user's hands when a cosmetic brush is washed directly by hand;
- to provide a cosmetic brush cleaning device in the form of a generally mitten-shaped closure configured to provide equal functionality, regardless of whether it is worn on the right or left hand;
- to provide a cosmetic brush cleaning device that does not require the user's attention in terms of gripping the device or maintaining the device against a tabletop or other support surface during use; and
- to provide a cosmetic brush cleaning device that provides for post rinsing removal of residue and excess moisture from the bristles.

SUMMARY

To achieve these and other objects, there is provided a device for washing and rinsing cosmetic brushes. The device includes a flexible, generally mitten-shaped enclosure comprising first and second opposed layers. The layers are joined along a periphery of the enclosure to define a proximal opening and an interior space to accommodate a user's hand when inserted into the enclosure through the proximal opening. An exterior surface of the enclosure comprises a first exterior surface of the first layer and a second exterior surface of the second layer. The enclosure comprises a proximal section adjacent the proximal opening, a distal section spaced apart longitudinally from the proximal section, a medial section between the proximal and distal sections, and an offset section extended generally laterally from the medial section. The proximal section, the distal section, the medial section and the offset section are disposed in surrounding relation respectively to the wrist, the fingers, the palm and back of the hand, and the thumb when the hand is so inserted. A plurality of first texturing features are formed along a first surface region of the first exterior surface to provide a directionally neutral first texture to accommodate movement of a brush head substantially equally in all directions along the first exterior surface. A plurality of second texturing features are formed along a second surface region of the first exterior surface to provide a directionally oriented second texture adapted for movement of a brush head in a first predetermined direction along the first exterior surface.

The first texture, being directionally neutral or balanced, accommodates a circular or swirling motion of a brush head over the first surface region. Accordingly, this texture is particularly well suited to the washing stage, where the user is attempting to work a liquid cleaning solution into the bristles and expose as much bristle surface area as possible to contact with the solution.

In contrast, the second texture is directionally oriented, e.g. comprised of parallel elongate ridges or other features that promote movement of the brush head back and forth in a predetermined direction. The back and forth motion correspond to the rinsing stage, where wiping action over a maximum bristle surface area remains important, yet the need for preliminary shaping of the brush head also is taken into account.

Preferably, the first layer overlies the palmar side of the hand when the device is worn, with the first texturing features formed along the medial section and the second texturing features formed along the distal section of the enclosure. This locates the first texture over the palm. The palm is naturally preferred by the user when pushing and moving the brush head against the hand during the washing stage. The second texture is positioned along the fingers, corresponding to the user's natural tendency to work the brush head with the fingers when rinsing the brush head under running water.

In a preferred version of the device, texturing features are formed over the second layer to provide third and fourth textures overlying the dorsal side of the hand. The third and fourth textures are advantageously configured for washing and rinsing cosmetic brushes. More particularly, the first and second textures can be configured for larger brushes while the third and fourth textures are configured for smaller brushes.

Another aspect of the present invention is a device for cleaning and removing excess moisture from cosmetic brushes. The device includes a flexible enclosure comprising first and second opposed layers. The layers are joined along a periphery of the enclosure to define a proximal opening and an interior space to accommodate a user's hand when inserted into the enclosure through the proximal opening. An interior surface of the enclosure comprises a first exterior surface of the first layer and a second exterior surface of the second layer. The enclosure comprises a proximal section adjacent the proximal opening, a distal section spaced apart longitudinally from the proximal section to accommodate the fingers, a medial section between the proximal and distal sections, and a thumb section offset laterally from the medial section to accommodate the thumb. A first textured surface arrangement is formed along the first exterior surface to facilitate a washing and rinsing of a cosmetic brush head by selective movement of the brush along the first textured surface arrangement. A substantially smooth surface region is formed along adjacent portions of the first and second layers to provide first and second confronting surfaces along the thumb section, and an index-finger side of the medial and distal sections. These surfaces facilitate use of the thumb and index finger to compress a brush head between the first and second confronting surfaces when the hand is so inserted.

The first and second confronting surfaces are advantageously formed as first and second elongate regions of a continuous smooth surface. The device, particularly along the adjacent portions of the first and second layers, can be provided with increased thickness so that the confronting surfaces are raised relative to adjacent portions of the first and second exterior surfaces.

A further aspect of the invention is a device for washing and rinsing cosmetic brushes of different types and sizes. The device includes a flexible enclosure having first and second opposed layers. The layers cooperate to define an interior space between the layers to accommodate a user's hand when inserted into the enclosure through an opening at a proximal end of the enclosure. An exterior surface of the enclosure comprises first and second frontal surface regions of the first layer and first and second back surface regions of the second layer. A plurality of first texturing features are substantially evenly distributed over the first frontal surface region to provide a directionally neutral first texture to accommodate movement of a brush head substantially equally in all directions along the first frontal surface region for washing cosmetic brushes. A plurality of elongate second texturing features extend along the second frontal surface region in substantially parallel fashion. These features are substantially uniformly spaced apart to provide a directionally oriented second texture for movement of a brush head in a predetermined direction along the second frontal surface region for rinsing cosmetic brushes. A plurality of elongate third texturing features extend over the first back surface region and are oriented in different directions to provide a directionally neutral third texture for washing cosmetic brushes. A plurality of elongate fourth texturing features extend along the second back surface region in substantially parallel fashion and are substantially uniformly spaced part, to provide a directionally oriented fourth texture for rinsing cosmetic brushes.

In one preferred version of the device, the first texturing features comprise rounded nodules. Each nodule has a radius, taken at the first frontal surface region, at least as great as a nodule height taken in a direction away from the first frontal surface region. In addition, each of the second, third, and fourth texturing features has a width (taken at its associated one of the second frontal surface region, first back surface region and second back surface region) at least as great as its height in the direction away from its associated surface region. The relationship of feature radius or width to feature height results in stable features that produce effective wiping action against the bristles as the brush head is moved across the associated surface region.

In further preferred versions of the device, fifth texturing features can be formed over a third frontal surface region of the first layer, and a third back surface region of the second layer. The fifth texturing feature can comprise substantially uniformly arranged bristles, each elongate in a height direction and having a height greater than the diameter taken at its associated surface region. The bristles are laterally spaced apart adjacent bristle by a distance less than the diameter.

The structure of the bristles and their density cooperate to allow substantial penetration into the bristles of the brush head, along with effective wiping action along the bristles of the brush to remove any residue remaining after the washing and rinsing steps. The bristles are effective in cleaning residues that are difficult to remove in the washing and rinsing stages, such as liquid foundation and gel eyeliner typically applied with large and small synthetic brushes, respectively.

The preferred version of the enclosure comprises a primary section to accommodate the fingers, and a thumb section along one side of the primary section to accommodate the thumb. The exterior surface advantageously comprises a smooth texture disposed along adjacent portions of the first and second layers to provide smooth confronting surfaces of the thumb section and an index finger side of the primary section. This facilitates use of the thumb and the index finger to compress a brush head between the confronting surfaces.

When provided with texturing features for washing and rinsing along the frontal surface regions and the back surface regions, with bristles along the frontal and back surfaces, and with smooth confronting surfaces along the primary section and thumb section, the device can be used in a four-stage process for thoroughly cleaning and removing excess moisture from the larger cosmetic brushes used to apply facial makeup, and the smaller cosmetic brushes used to apply eye makeup. Nodules and ridges along the frontal and back surfaces form textures that enhance both washing and rinsing of the brush head. The bristles effectively penetrate and wipe the brush head for removal of residue remaining after washing and rinsing. Finally, the confronting surfaces when compressing the brush head effectively remove excess moisture for substantially reduced brush drying times.

Selective shaping and arranging of the texturing features allows the device to support different washing and rinsing regions tailored to suit both larger brushes and smaller brushes, respectively. With the device worn on the hand like a mitten or glove, it does not require any attention for gripping, balancing, or otherwise maintaining the device. The user's attention can be devoted entirely to manipulating the brush head against the selected texture. Further, the textured areas can be selectively positioned on the device such that the user replicates natural hand movement and placement when a cosmetic brush is washed and rinsed directly by hand.

Yet another aspect of the invention is a device for washing and rinsing cosmetic brushes. The device includes a flexible enclosure having first and second opposed layers cooperating to define an interior space between the layers to accommodate a user's hand when inserted into the enclosure through an opening at a proximal end of the enclosure. The enclosure further has an exterior surface comprising a frontal surface of the first layer and a back surface of the second layer. The enclosure comprises a primary section to accommodate the palmar area of the hand and the fingers when the hand is so inserted. A first thumb section is disposed along a first side of the primary section. A second thumb section is disposed along a second and opposite side of the primary section. The enclosure is adapted to alternatively accommodate the hand: (i) in a first orientation with the first layer confronting the palm, the second layer confronting the back of the hand, and the first thumb section accommodating the thumb; and (ii) in a second orientation with the second layer confronting the palm, the first layer confronting the back of the hand, and the second thumb section accommodating the thumb. A first textured surface arrangement is formed along the frontal surface to facilitate washing and rinsing of a cosmetic brush head by selective movement of the brush head along the first textured surface arrangement. A second textured surface arrangement is formed along the back surface to facilitate washing and rinsing a cosmetic brush head by selective movement of the brush head along the second textured surface arrangement.

Thus in accordance with the present invention, a brush cleaning device conveniently supported by hand affords more effective washing and rinsing of cosmetic brushes, and provides for effective post-rinse removal of residue and excess moisture.

IN THE DRAWINGS

For a further understanding of the above and other features and advantages, reference is made to the following detailed description and to the drawings, in which.

Figure 5:
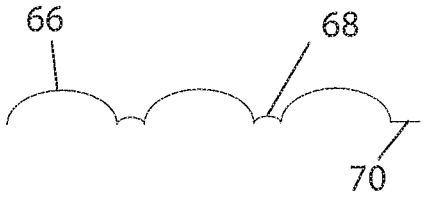
Figure 7:
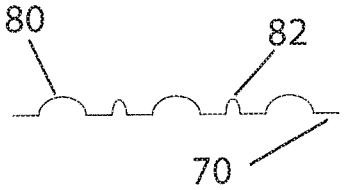
Figure 8:
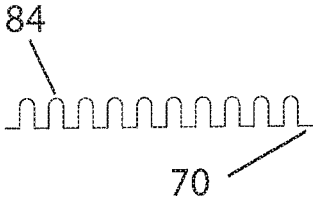
Figure 9:
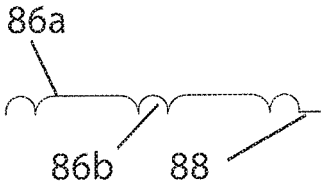
Figure 10:
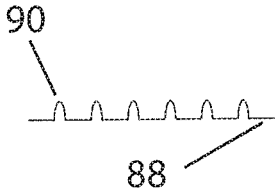
Figure 6:
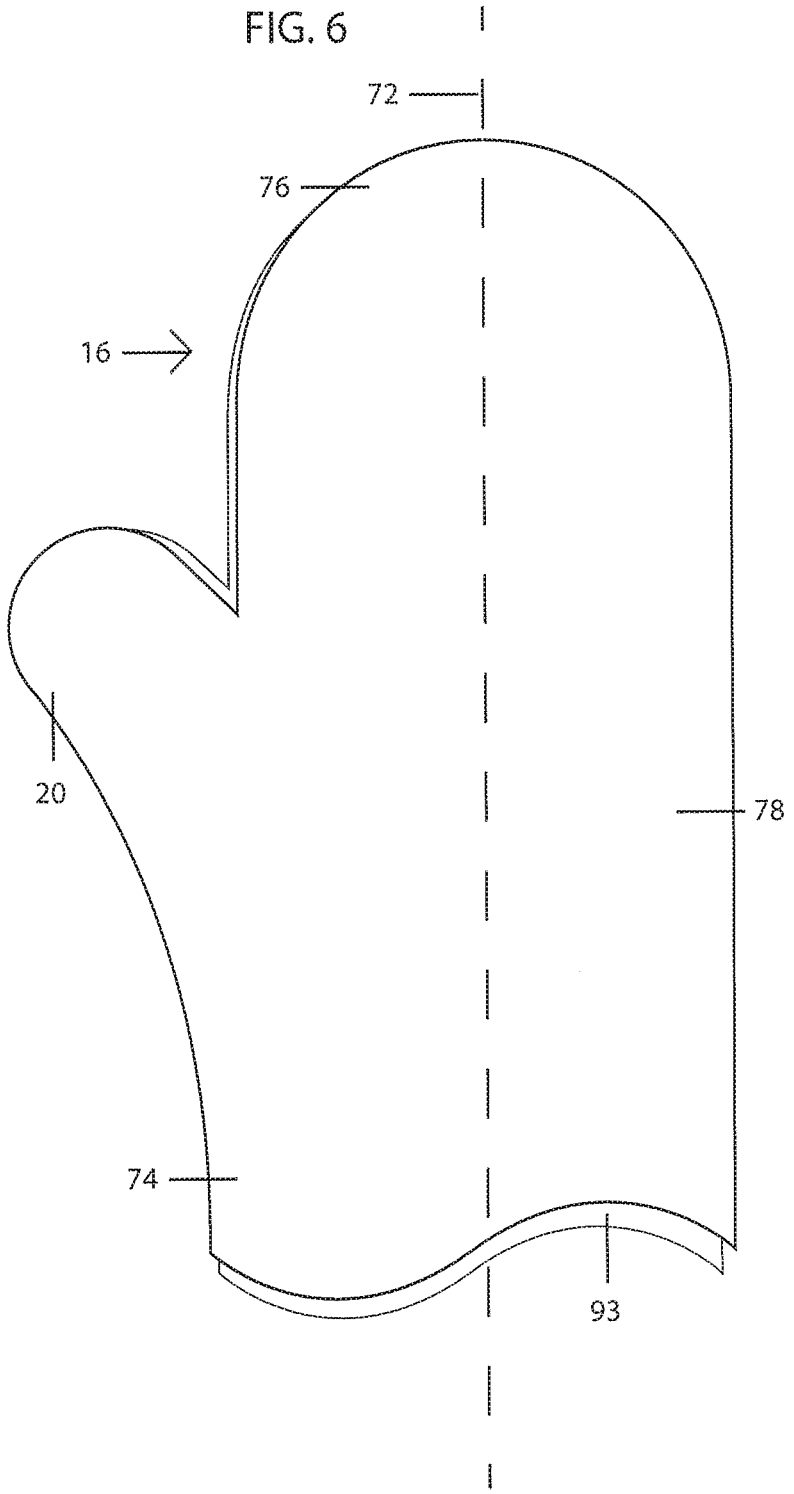
Figure 11:
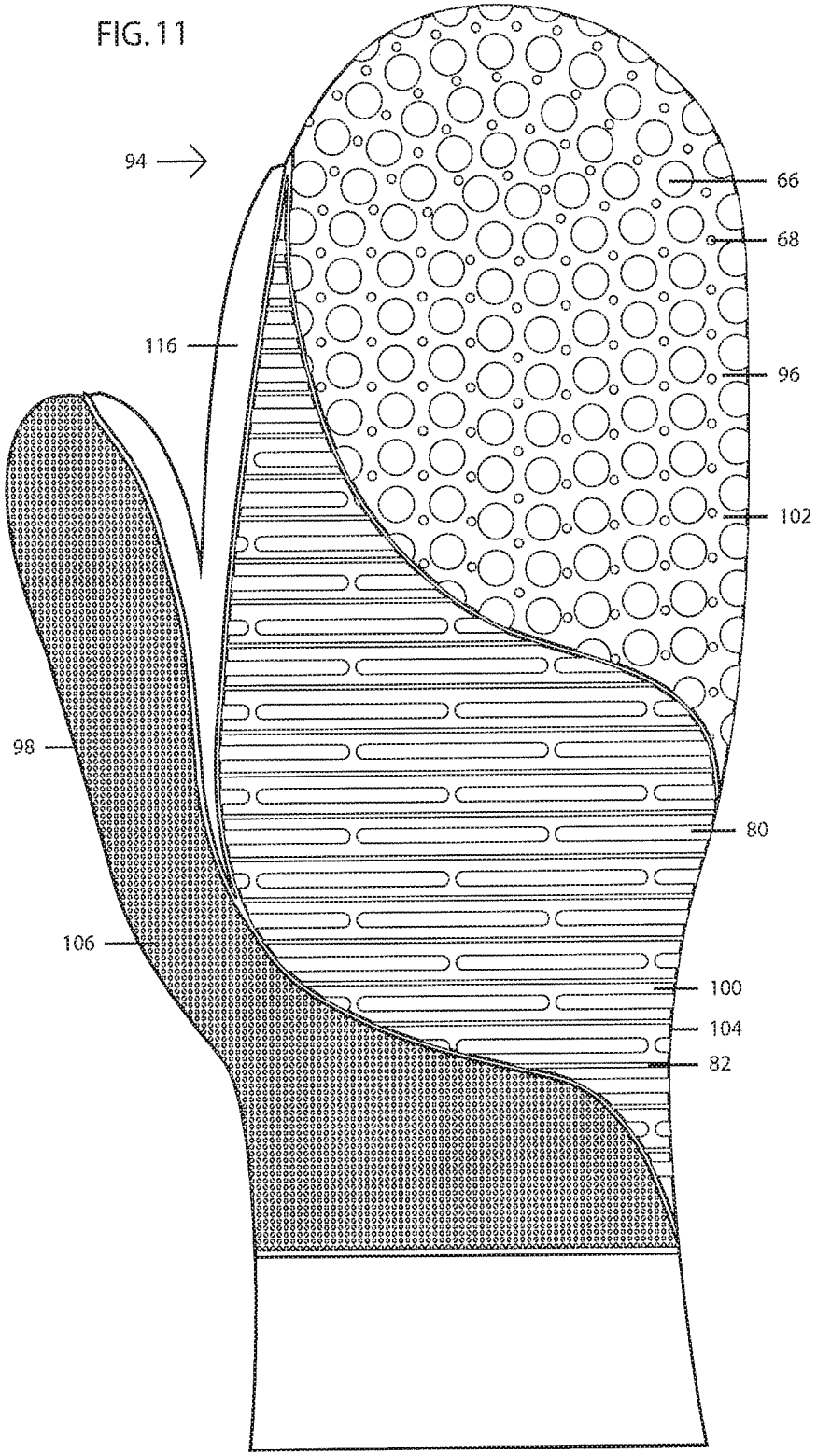
Figure 12:
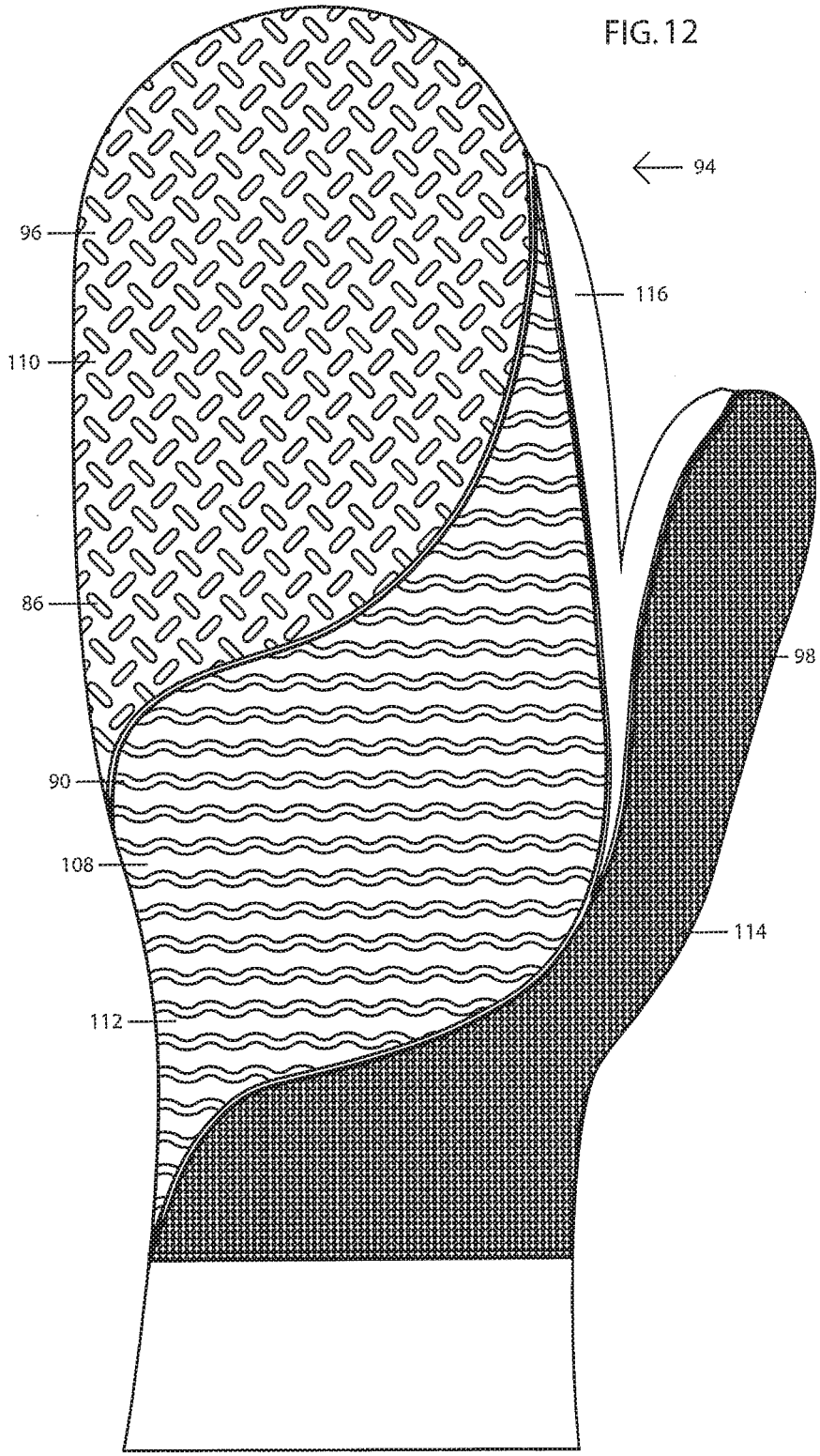
Figure 13:
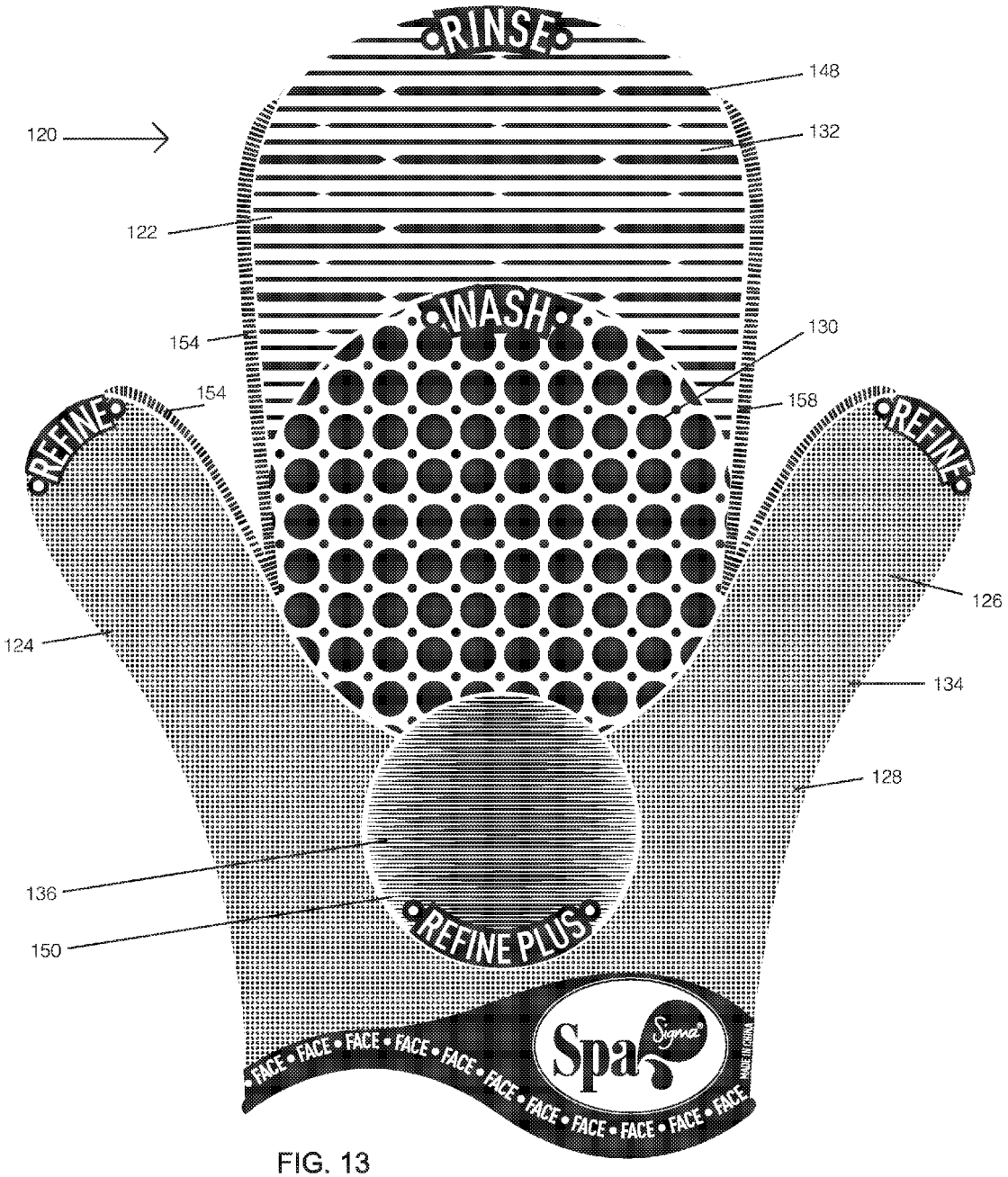
Figure 14:
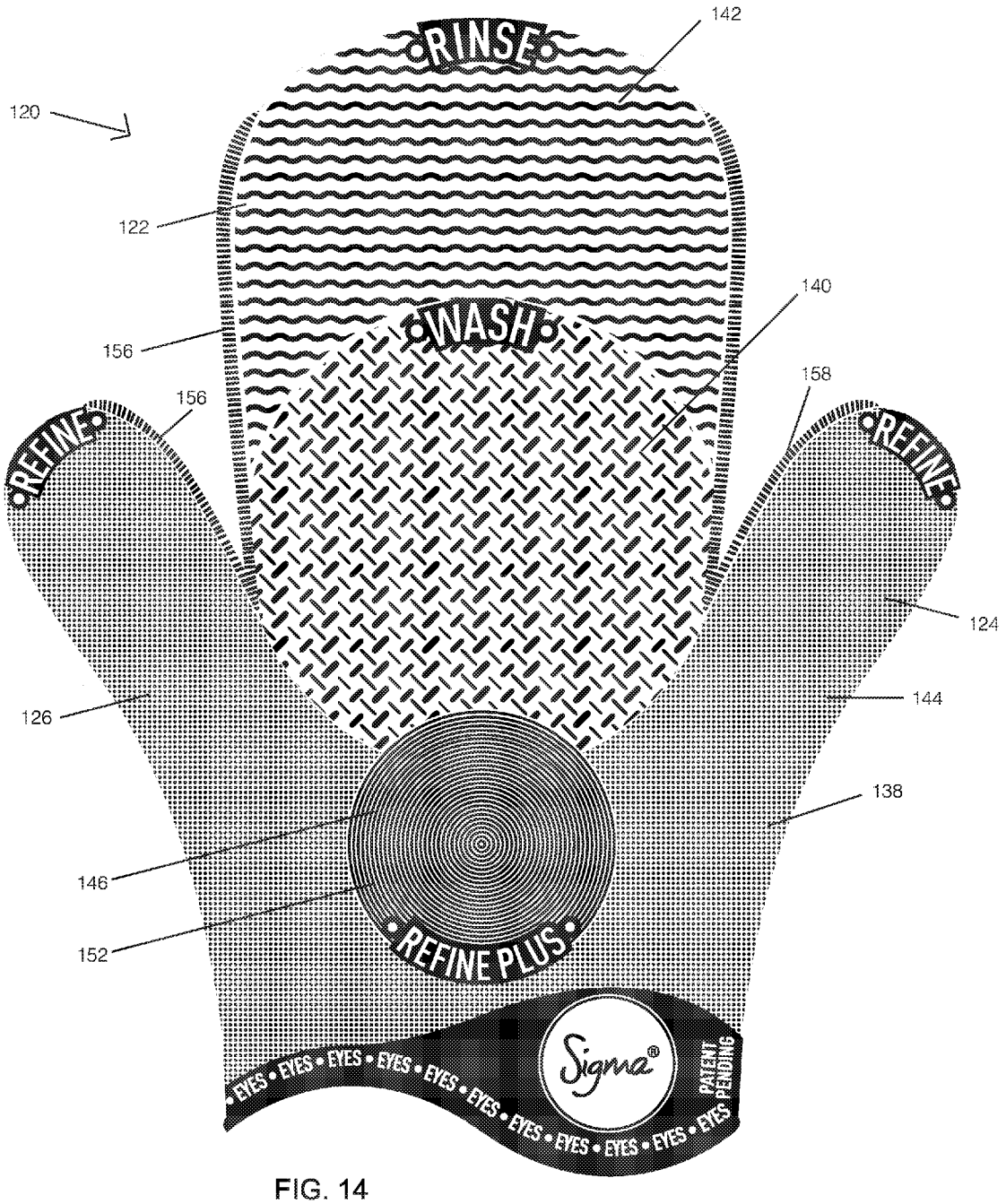

FIG. 5 schematically illustrates a brush washing texture formed along a frontal exterior surface of the device;

FIG. 6 is a diagrammatic frontal view of the device with broken lines indicating several different functional sections of the device;

FIGS. 7-8 schematically illustrate rinsing and post-rinse textures formed along the frontal exterior surface of the device;

FIGS. 9-10 schematically illustrate washing and rinsing textures formed along a rear exterior surface of the device;

FIG. 11 is a frontal elevation of an alternative embodiment cosmetic brush cleaning device; and FIG. 12 is a rear elevation of the device shown in FIG. 11;

FIG. 13 is a frontal elevation of a further alternative embodiment cosmetic brush cleaning device; and FIG. 14 is a rear elevation of the device shown in FIG. 13.

DETAILED DESCRIPTION

Figure 1:
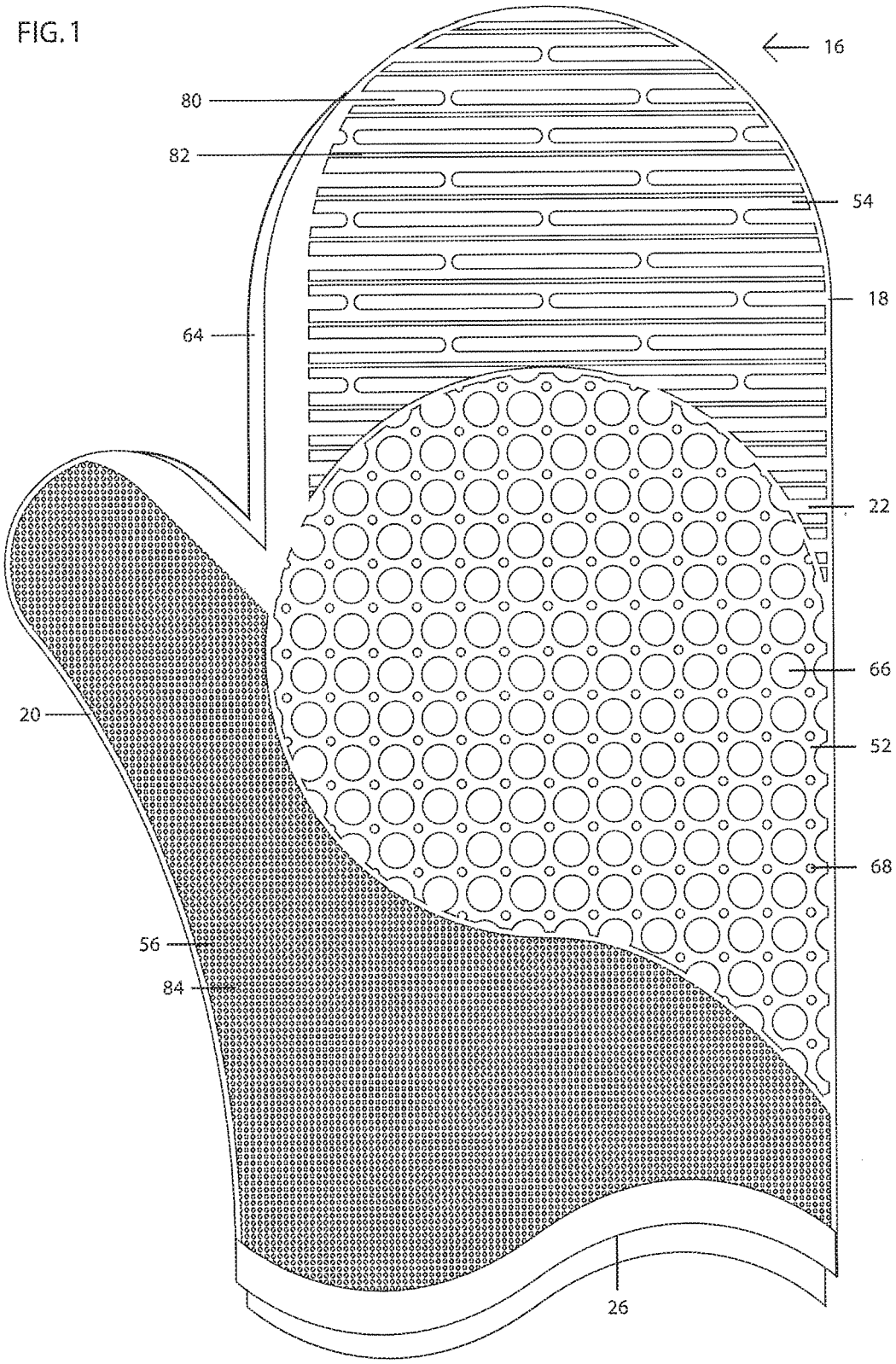
FIG. 1 is a frontal elevation of a device for cleaning cosmetic brushes, constructed in accordance with the present invention.
Figure 2:
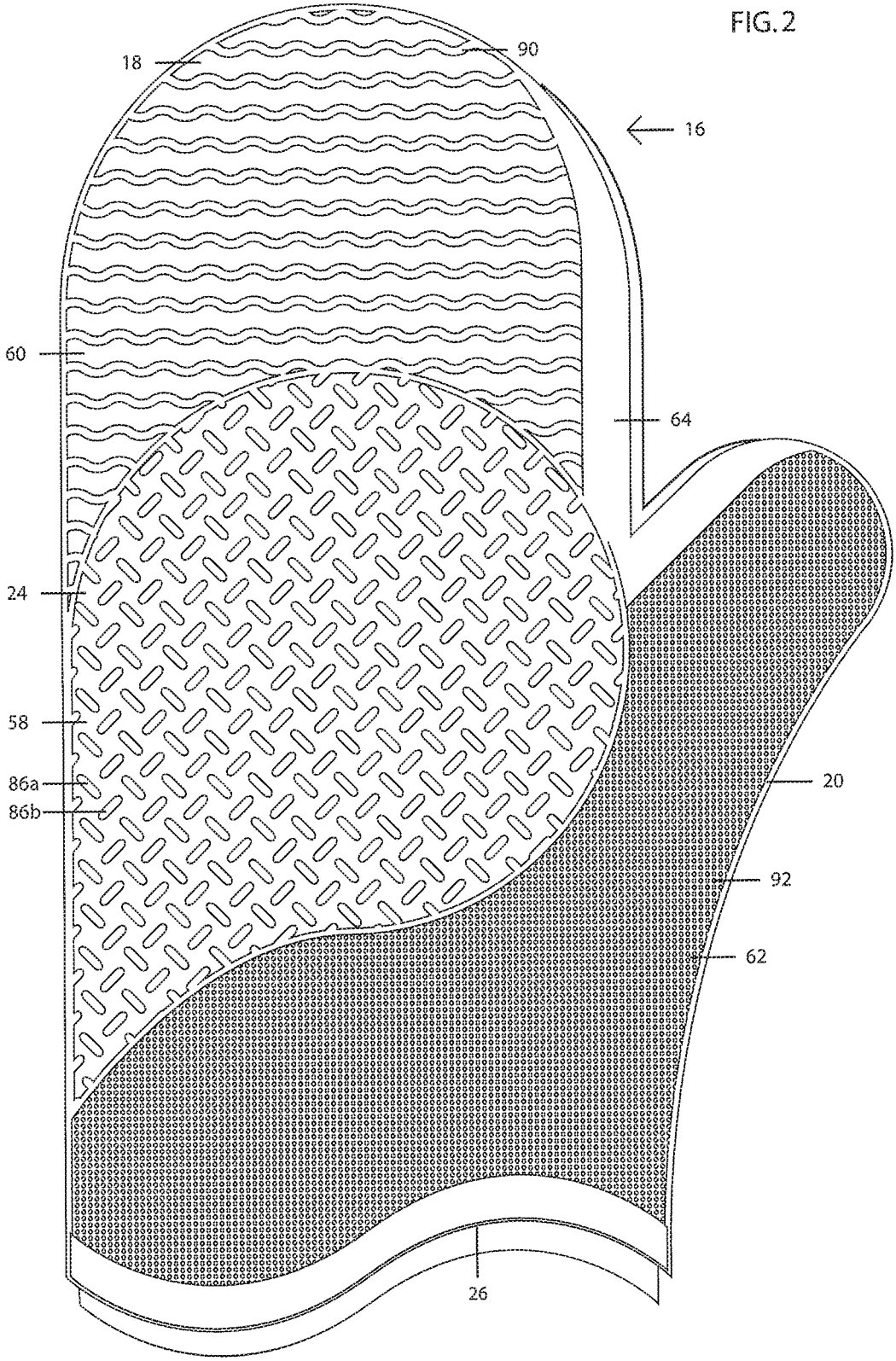
FIG. 2 is a rear elevation of the device.

Turning now to the drawings, there is shown in FIGS. 1 and 2 a device 16 for cleaning cosmetic brushes. The device is intended to be worn on the hand during use, and to that end is formed as a mitten-shaped enclosure. A main body section 18 of the device accommodates the palm and fingers (other than the thumb) and a thumb section 20 offset from the main body section accommodates the thumb. Device 16 preferably is formed of silicone rubber or another suitable elastomer to provide a favorable combination of structural integrity and flexibility, while being nonreactive and water impermeable. Another suitable material is latex.

Device 16 is homogeneous and formed as a single piece. However, in functional terms it can be considered to consist of two complementary opposed layers or panels: a frontal panel 22 and a rear panel 24. Panels 22 and 24 are joined along the periphery of device 16, except along a proximal end 26 where an opening accommodates insertion of the hand into the enclosure interior.

Device 16 can be worn on either hand, although it is designed primarily for the left hand. More particularly, frontal panel 22 is a palmar layer overlying the palm and fingers of the left hand, while rear panel 24 overlies the back of the hand and fingers.

Figure 3:
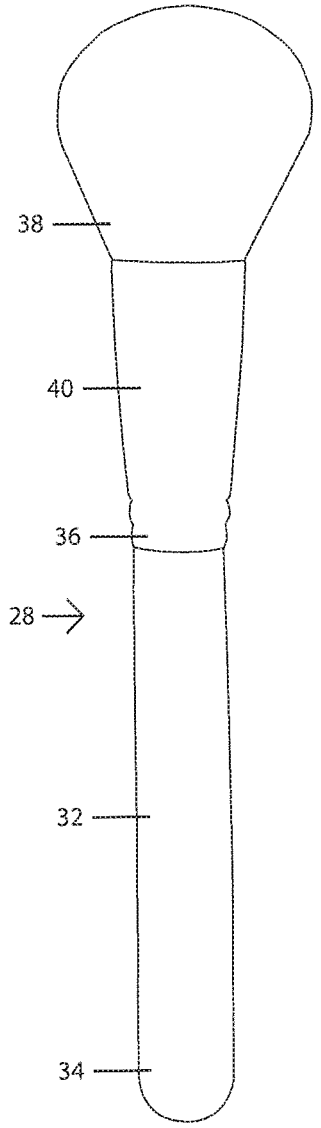
FIG. 3 is an elevation of a cosmetic brush typically used in facial applications.
Figure 4:
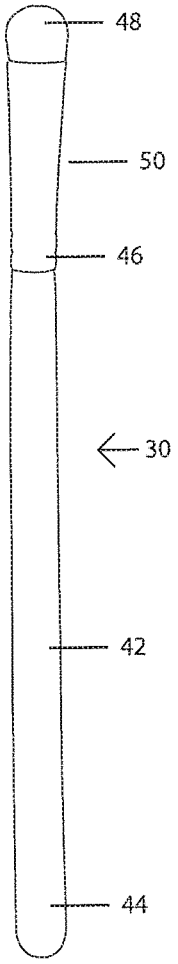
FIG. 4 is an elevation of a cosmetic brush typically used to apply eye makeup.

The exterior surface of device 16 is formed with a variety of textures for cleaning different sizes of cosmetic brushes, more particularly larger brushes such as a brush 28 shown in FIG. 3 designed to apply blush and other cosmetics to the face, and smaller brushes such as brush 30 shown in FIG. 4 used to apply eye makeup. With reference to FIG. 3, facial brush 28 includes an elongate handle 32 having a proximal end region 34 and a distal end region 36, multiple natural or synthetic bristles arranged in a bundle or head 38, and a ferrule 40 surrounding the handle and the proximal ends of the bristles. The ferrule compacts the bristles, and supports head 38 with respect to the handle. Head 38 is flared in the sense that the more centrally located bristles extend in the lengthwise direction of the handle, and the more peripheral bristles are slightly outwardly inclined while still extending generally lengthwise. The head has a circular profile in planes perpendicular to the length of the brush.

FIG. 4 illustrates brush 30 with an elongate handle 42 having a proximal end region 44 and a distal region 46, multiple natural or synthetic bristles arranged in a head 48 and a ferrule 50 compacting and supporting the bristles with respect to the handle. Again, the bristles extend at least generally in the longitudinal direction. Head 48, in contrast to head 38 of brush 28, frequently is flattened to have a linear, elliptical or other noncircular profile in planes perpendicular to the length of the brush.

The exterior surface of device 16 is formed with textures tailored to cleaning brushes 28 and 30. More particularly, the exterior surface of frontal layer panel 22 includes a textured surface region 52 for washing brush 28, a textured surface region 54 for rinsing, and a textured surface region 56 for a refining, i.e. a post-rinse removal of any residue remaining after rinsing. Similarly, the exterior surface of rear panel 24 includes a textured surface region 58 for washing brush 30, a textured surface region 60 for rinsing, and a textured surface region 62 for post-rinse residue removal.

In addition, a smooth surface region 64 is formed along adjacent portions of panels 22 and 24, extending along an index-finger side of main body section 18 and along thumb section 20. The portions of smooth surface region 64 along the main body section and thumb section confront one another. Preferably, panels 22 and 24 have an increased thickness over region 64.

Preferably, device 16 is formed by injection molding of the silicone or other elastomer to integrally form the textured surface regions via the molding process.

As noted above, the textured regions are tailored to cosmetic brushes of different sizes, with textured regions on the frontal panel suited to facial brushes and the rear panel textures suited to smaller brushes to apply eye makeup. In addition, the textured regions of each panel are individually tailored to the stages of cosmetic brush cleaning: washing, rinsing, and post-rinsing residue removal.

With reference to FIGS. 1 and 5, the texture of surface region 52 is formed by multiple rounded nodules of two sizes: larger nodules 66 and smaller nodules 68. Nodules 66 and 68 are intermingled, and each of the nodule sizes is evenly distributed over surface region 52.

The nodules of each size are segmented spherical in shape, defined by a segment that encompasses at most a hemispherical shape and always encompasses an outer surface of the sphere to provide rounded crown shape. In one version of device 16, larger nodules 66 extend away from a nominal surface or base 70 of the panel exterior surface, have a diameter of 8 mm (i.e. 4 mm radius) at the base, and a height of 2.5 mm in a height direction away from and normal to the base. Smaller nodules 68 have a 1 mm radius and a 1 mm height. The distribution of nodules 66 is dense such that adjacent nodules 66 are spaced apart by a distance less than their diameter. The number of small nodules formed over surface region 52 is substantially the same as the number of nodules. The nodules are arranged in a symmetrical pattern, with each large nodule surrounded by four smaller nodules, and each smaller nodule similarly surrounded symmetrically by four of the larger nodules. As a result, the texture of surface region 52 is directionally balanced or directionally neutral, in the sense that the texture provides the same resistance to the movement of a cosmetic brush head over surface region 52, regardless of the direction of brush movement along the surface.

The size, shape, density, and distribution of nodules 66 and 68 provide a highly favorable texture for washing brush 28 and other larger cosmetic brushes. The purpose of the washing stage is to penetrate brush head 48 with the cleaning solution, e.g. water combined with soap or shampoo, to separate adjacent bristles and expose as much bristle surface area as possible to the solution. This entails broad, vigorous circular motion and rotation of head 48 against surface region 52, while applying intense pressure to the head. The absence of an orientation, i.e. the directional neutrality of the texture, facilitates the desired circular motion and rotation. The shape of nodules 66 and 68 results in a stable texture and minimizes the potential for damage to the bristles during the washing stage. The intermingling of nodules 66 and 68 increases the area of contact with the bristles and improves the wiping action, resulting in more efficient removal of makeup from the bristles.

A salient feature of the present invention is the location of the textures on device 16 in a manner that encourages an individual to replicate hand movements and positioning that occur naturally when cleaning a brush directly by hand.

With reference to FIG. 6, with main body section 18 disposed on a longitudinal axis 72, device 16 includes a proximal section 74 that surrounds the wrist of a user wearing the device. A distal section 76, spaced apart longitudinally from the proximal section, surrounds the fingers other than the thumb. A medial section 78 between the proximal and distal sections is disposed about the palm and back of the hand. Finally, thumb section 20 is laterally offset from medial section 78.

With reference to FIG. 1, surface region 52 corresponds substantially to that portion of medial section 78 provided by frontal panel 22. As the user presses brush head 38 against surface region 52 while moving the brush head typically in circular fashion, the surface region is backed and supported by the palm of the hand. The hand not holding the brush is positioned as if the user was cleaning the brush directly by hand. Thus, the user of the device obtains the benefits afforded by textured surface region 52 without the need for new or unusual hand positions or movements.

The texture of surface region 54 is formed by elongate transversely extending ridges or bars 80 and 82. In one version of device 16, ridges 80 are slightly over 40 mm in length and 3.25 mm wide at base 70, and have a height of 1.25 mm. Ridges 82 extend along the complete transverse width of surface region 54, with a longitudinal width of 1 mm and a height of 1 mm. Ridges 80 and 82 are intermingled or alternating, to distribute each type of ridge evenly over the surface region.

The parallel ridges form a texture particularly well suited for the rinsing stage. The movement and applied pressure of brush head 38 against the surface are not as vigorous as required in the washing stage. Nonetheless, the need remains for maximum surface contact with and good wiping action against the bristles. Also, a back and forth movement of the brush head is preferred (in lieu of the circular motion) at the rinsing stage. The reciprocal motion provides sufficient surface contact and wiping action while being less disruptive to the shape of the bristles.

In each of ridges 80 and 82, the ridge width preferably is equal to or greater than the ridge height. Further, the ridges are preferably rounded, at least over the crown or surface of each ridge remote from base 70 of the frontal exterior surface. This provides for a stable texture and minimizes the potential for damage to the bristles. Further, as brush head 38 is moved longitudinally over the ridges, the alternating size arrangement improves surface contact and wiping action, to more efficiently remove makeup residue and soap from the bristles.

With reference to FIGS. 1 and 6, surface region 54 corresponds to distal section 76, placing the rinse texture over the fingers when device 16 is worn by hand. This corresponds to the natural tendency to use the fingers when a brush is rinsed directly by hand under running water. The fingers back and support frontal panel 22 as the brush head is moved back and forth over the ridges.

Textured surface region 56 is formed with multiple bristles 84 of uniform size, uniformly and densely distributed throughout the surface region. In one version of device 16, the bristles have a diameter of 0.9 mm and a height in the direction away from base 70 of 2 mm. Adjacent bristles 84 are spaced apart by a distance of 0.6 mm to provide a high bristle density. The bristles are arranged with no selected orientation, i.e. directionally balanced or neutral. As seen in FIG. 1, surface region 56 extends along frontal panel 22 adjacent the wrist, and upwardly along thumb section 20.

The shape and density of bristles 84 provide a texture suited to removing any makeup or soap residue remaining after brush head 38 has been washed and rinsed. The need for textured surface region 56 can arise for example when liquid foundation is applied, particularly when brush head 38 is formed of synthetic bristles. Liquid foundation stains are difficult to remove from synthetic brushes, and usually are not eliminated after the washing and rinsing steps. The high density and shape of bristles 84 provides improved penetration into brush head 38 as the head is moved over the surface region, typically in back and forth fashion. The density of bristles 84 also provides greater friction for improved wiping action against the bristles of the brush head, resulting in a complete cleaning of the bristles.

After the stages of washing, rinsing, and post-rinse removal or refining, device 16 can be used to remove excess moisture from brush head 38 to substantially reduce the time required for drying the bristles. Moisture removal is accomplished by placing brush 28 between thumb section 20 and the index finger side of main body section 18, thus to position brush head 38 between confronting portions of surface region 64, particularly the base of head 38 adjacent ferrule 40. Then, with the thumb moved toward the index finger to compress surface region 64 about brush head 38, device 16 is moved relative to the brush in the direction toward the free ends of the bristles. This tends to shape brush head 38 as it removes excess moisture.

With reference to FIGS. 2 and 9, the texture of surface region 58 is formed with multiple, somewhat elongate ridges or bars 86. Ridges 86 are uniform in size and shape, but are oriented in two different directions perpendicular to each other, as indicated at 86*a* and 86*b*. In one version of device 16, ridges 86 are 5.5 mm long, 2.5 mm wide at a base 88 of the exterior surface of panel 24, and have a height of 1.25 mm in the direction away from the base.

The washing of brush head 48 is similar to the washing of brush head 38 in that strong pressure is applied to the brush head as it is moved along the textured surface region, and further in that movement of the brush head is preferably broadly circular and rotational. At the same time, brush head 48 is distinguished from brush head 38 by its smaller size and the fact that the smaller brush heads frequently are flat rather than round in transverse profile. Ridges 86, due to their width, length, and height have been found to be more efficient for washing the smaller brush heads. The desired circular and rotational motions are facilitated by the directionally balanced arrangement of ridges 86.

With reference to FIGS. 2 and 10, the texture of surface region 60 is formed with parallel ridges 90 that extend generally transversely yet are undulating or somewhat sinusoidal. The arrangement of the ridges is directional, to facilitate a back and forth movement of brush head 48 in the longitudinal direction over surface region 60. Brush head 48, like brush head 38 is preferably moved in back and forth or reciprocal fashion for rinsing.

The undulating or wavy ridges have been found to be more efficient than linear ridges for removal of makeup residue and soap from smaller brushes. In particular, eye brushes as compared to facial brushes are used to apply more intensely pigmented products, e.g. eye shadows, eye shadow bases, and eye liners. The undulating nature of ridges 90 has been found to better remove the residues of these products after the washing step.

As best seen in FIG. 2, the placement of textured surface region 58 on rear panel 24 corresponds to the placement of surface region 52 on frontal panel 22, in that both correspond to medial region 78. Similarly, textured surface region 60, like textured surface region 54, corresponds to distal region 76 of the device. Accordingly, when device 16 is worn on the left hand, surface region 58 overlies the back of a hand and surface region 60 overlies the dorsal side of the fingers.

The texture of surface region 62 is formed by multiple bristles 92, substantially identical in size and shape to bristles 84 and having substantially the same density. Accordingly, the texture of surface region 62 is substantially identical to the texture of surface region 56. Like surface region 56, surface region 62 extends along proximal section 74 overlying the wrist, then upwardly along thumb section 20.

For increased user comfort, device 16 can include a liner 93 (FIG. 6). The liner is formed in the shape of a mitten, to be worn by hand and disposed between the hand and the mitten-shaped enclosure when the device is in use. The liner preferably is made of cotton or another water absorbent material.

Device 16 fits either hand, but is designed primarily for wearing on the left hand while the brush being cleaned is held in the right hand to effect the desired movement of the brush head along a given surface region.

For large brushes, the washing stage typically involves applying a liquid cleaning solution to surface region 52 with the palm facing upward, then manipulating the brush head against that surface region to maximize contact of the bristles with the cleaning solution. In the rinsing stage, surface region 54 is placed under a faucet or other source of running water while the brush is manipulated with the right hand to move the brush head longitudinally back and forth over ridges 80 and 82.

In the post-rinsing stage, the brush head is moved in either circular or reciprocal fashion for the desired wiping action of the surface texture bristles against the bristles of the brush. Finally, the brush head is drawn between opposing portions of surface region 64 while the thumb and index finger cooperate to compress the brush head, thus to remove excess moisture.

The procedure for cleaning smaller brushes is substantially similar, depending on the hand used to support device 16.

It is believed that most users will prefer to keep device 16 on the left hand when cleaning a smaller brush. Thus, in the washing stage the cleaning solution is applied to back panel 24 overlying the back of the hand, rather than to the frontal panel overlying the palm. During the rinsing stage, the brush head is moved along ridges that overly the dorsal side rather than the palmar side of the fingers. In the post-rinsing stage, the user may select either surface region 56 or surface region 62, thus to support the bristles with the palm of the hand or back of the hand, as desired. Finally, the moisture removal stage for the small brush is identical to that for the large brush.

As an alternative, the user may switch device 16 to the right hand for cleaning smaller brushes, in which case surface regions 58 and 60 overlie and are supported by the palm and palmar side of the fingers, respectively.

FIGS. 11 and 12 illustrate an alternative embodiment brush cleaning device 94 including a main body section 96 to accommodate the palm and fingers and a thumb section 98. A frontal panel 100 (FIG. 11) incorporates a textured surface region 102 for washing brush 28, a region 104 for rinsing, and a region 106 for post-rinsing residue removal. The exterior surface of a rear panel 108 (FIG. 12) includes a textured surface region 110 for washing brush 30, a textured region 112 for rinsing, and a textured region 114 for post-rinsing residue removal. Device 94 further incorporates a smooth surface region 116 similar to region 64 of device 16.

Device 94 differs from device 16 in that the washing regions, surface regions 102 and 110, are placed along the distal region of the device. Accordingly, these surface regions are supported by the fingers, either along the palmar or dorsal side. Rinsing surface regions 104 and 112 are supported by the palm and the back of the hand, respectively.

The brush washing and rinsing textures, while located over the fingers rather than the palm and back of the hand (and vice versa), are substantially the same. The post-rinsing surface regions likewise are substantially identical. Accordingly, device 94 is used in much the same manner as described above for device 16. Device 94 is a suitable alternative to device 16, particularly for users inclined toward more active use of the fingers in the washing stage. Nonetheless, device 16 is likely to be favored by most users, due to its preferred placement of the washing textures.

Either of devices 16 and 94 may be modified to incorporate modified textured surface regions (not shown). For example, the surface region corresponding to rinsing large brushes may incorporate transversely extending ridges of only one size. The surface region for rinsing smaller brushes may be formed with pluralities of short, spaced part transversely extending ridges in lieu of single ridges extending across the complete width of the surface region. The shorter ridges may incorporate curvature in corresponding to the undulating longer ridges. Further in alternative versions of the device, the sizes and shapes of the texturing regions can be varied, e.g. to provide a larger post-rinsing textured surface region or purely for aesthetics.

FIGS. 13 and 14 illustrate an alternative embodiment brush cleaning device 120 including a central, primary section 122 to accommodate the palm and fingers, and thumb sections 124 and 126 extending at an incline and generally laterally away from opposite sides of primary section 122. A frontal panel 128 (FIG. 13) incorporates a textured surface region 130 for washing brush 28, a region 132 for rinsing, a region 134 for post-rinsing residual removal, and a textured surface region 136 for further post-rinsing. The exterior surface of a rear panel 138 (FIG. 14) includes a textured surface region 140 for washing brush 28, a textured region 142 for rinsing, a textured region 144 for post-rinsing residual removal, and an additional textured surface region 146 for further post-rinsing removal of residue.

Device 120 is similar to device 16 in the placement of the textured surface regions for washing and rinsing. In other respects, device 120 differs from device 16. For example, as compared to device 16, the heights of the texturing features are increased by 1-2 mm. In addition, texturing features 148 of region 132, as compared to ridges 80 and 82 of surface region 54, are somewhat sharper and less rounded. This has been found to facilitate bringing water further into the interior regions of the brush head.

The texture of post-rinsing region 136 is formed by elongate ridges or bars 150. Ridges 150 extend transversely across the entire width of region 136. In one version of the device, ridges 150 are 1.5 mm. wide at the base, and have a height of 2.4 mm. Adjacent ridges 150 are spaced apart longitudinally 0.5 mm. from each other. When brush 28 is moved longitudinally over surface region 136, i.e., perpendicular to ridges 150, the ridges provide a resistance to bristle movement that facilitates eliminating cream and liquid foundation from the bristles.

The texture of surface region 146 is formed by concentrically-arranged circular ridges 152. The ridges have a width of 0.5 mm. at the base, and a height of 2.8 mm. Adjacent ridges are spaced apart from one another by a radial distance of 0.5 mm. This texture has been found to facilitate separation of adjacent bristles of brush 30, allowing soapy water to penetrate the bristles more deeply.

A shaping surface 154 is formed along adjacent portions of panels 128 and 138, extending along thumb section 124 and a portion of primary section 122. Portions of shaping surface 154 along thumb section 124 and the primary section confront one another. In similar fashion, a shaping surface 156 is formed along thumb section 126 and an adjacent portion of primary section 122, to provide confronting surface regions of shaping surface 156. A plurality of elongate, parallel and spaced apart ridges 158 are formed along each of shaping surfaces 154 and 156. These ridges extend generally perpendicular to major planes of the frontal and rear panels.

After the stages of washing, rinsing and post-rinse removal or refining, either one of shaping surfaces 154 and 156 can be used to remove excess moisture while also shaping the brush head. This is accomplished by placing brush 28 (or brush 30) between the chosen thumb section and the primary section to position the brush head between confronting regions of the chosen shaping surface. Then, as described previously in connection with device 16, the thumb is moved toward the index finger to compress the chosen shaping surface regions about the brush head while device 120 is moved relative to the brush in the direction toward the free ends of the bristles.

The most striking difference of device 120 with respect to devices 16 and 94, is the provision of two thumb sections 124 and 126. This provides a more universal fit, enhancing the utility of the device.

Although device 16 (for example) can be worn on either hand, the single thumb section requires that front panel 22 overlie the palm when the device is worn on the left hand, and rear panel 24 overlie the palm when the device is worn on the right hand. Users who are right-handed tend to prefer manipulating the cosmetic brush with the right hand, while wearing the device on the left hand. In this case, washing a large (facial) brush entails pushing the brush against textured surface region 52, in effect pushing the brush against the palm of the left hand. Washing a small brush entails pushing the brush against textured surface region 58, in effect pushing the brush against the back of the left hand.

The preference for pushing against the palm when washing a small brush can be met by changing the device to the right hand. However, this requires the user to manipulate the brush with the left hand while the glove is on the right hand, contrary to the preference of the right-handed user. The left-handed user encounters the same problem, although it occurs in connection with a large brush rather than the small brush.

Device 120, of course, can be worn on either hand. And with respect to either hand, the device can be worn to place either the front panel or the rear panel against and overlying the palm, as desired. As a result, users can simultaneously satisfy their preferences as to which hand manipulates the brush, and which panel (frontal or rear) overlies the palm. This flexibility is particularly beneficial for pushing the brush against the chosen panel and palm during the washing step, but also aids the rinsing and post-rinsing steps.

Thus in accordance with the present invention, a cosmetic brush cleaning device is provided with a variety of surface textures specifically tailored to cleaning larger and smaller brushes, and further specifically tailored to washing, rinsing, and post-rinsing stages of brush cleaning. Because the device fits over the hand like a mitten, the user can support the device without gripping, balancing or otherwise attending to the device during use. Finally, the device facilitates a placement of textures corresponding to different cleaning stages, such that hand placement and movement during use replicates placement and movement of the hand when a brush is cleaned directly by hand.

The invention claimed is:

1. A method of using a device for washing cosmetic brushes, the method comprising:

providing the device on a user's hand;

applying a cleaning solution to the device;

washing a cosmetic brush head along a plurality of first texturing features distributed over a first surface region of the device to provide a directionally neutral first texture adapted for movement of the cosmetic brush head substantially equally in all directions along the first surface region for washing the cosmetic brush head; and washing the cosmetic brush head along a plurality of second texturing features distributed over a second surface region of the device to provide a directionally neutral second texture adapted for movement of the cosmetic brush head substantially equally in all directions along the second surface region for washing the cosmetic brush head;

wherein the first texturing features comprise multiple bristles formed over the first surface region, the bristles elongate in a height direction and having a height greater than a diameter thereof; and wherein the second texturing features comprise multiple nodules formed over the second surface region, the nodules having a width at least as a great as a height thereof.

2. The method of claim 1, further comprising washing the cosmetic brush head along a plurality of third texturing features distributed over a third surface region of the device to provide a directionally neutral third texture adapted for movement of the cosmetic brush head substantially equally in all directions along the third surface region for washing the cosmetic brush head.

3. The method of claim 2, wherein the plurality of third texturing features extend in the third surface region in at least two mutually perpendicular directions.

4. The method of claim 1, further comprising inserting the user's hand into a section of the device adapted to accommodate a user's hand.

5. A method of using a device for washing brushes, the method comprising:

providing the device;

washing a brush head along a plurality of first texturing features comprising bristles formed over a first surface region of the device, each of the bristles being elongate in a height direction and having a height greater than a diameter thereof;

washing the brush head along a plurality of second texturing features comprising nodules formed over a second surface region of the device, each of the nodules having a width at least as a great as a height thereof; and washing the brush head along a plurality of third texturing features distributed over a third surface region of the device, the third texturing features extending in the third surface region in at least two mutually perpendicular directions;

wherein the diameter of the bristles is taken at the first surface region; and wherein the width of the nodules is taken at the second surface region.

6. The method of claim 5, further comprising applying a cleaning solution to the device.

7. The method of claim 6, further comprising manipulating the brush head at a location of the device to which the cleaning solution was applied to maximize contact with the cleaning solution.

8. The method of claim 5, wherein the nodules comprise rounded nodules.

9. The method of claim 5, wherein the plurality of second texturing features comprise first and second different kinds of intermingled nodules.

10. The method of claim 5, further comprising inserting a hand into a section of the device adapted to accommodate a hand.

11. The method of claim 5, further comprising rinsing the brush head.

12. The method of claim 5, wherein washing the brush head along the plurality of first texturing features, the plurality of second texturing features, or the plurality of third texturing features comprises pressing the brush head against a surface region while moving the brush head in a circular fashion or in a swirling motion.

13. The method of claim 5, further comprising moving the brush head along the plurality of first texturing features, the plurality of second texturing features, or the plurality of third texturing features comprises in a back and forth fashion.

14. The method of claim 5, wherein washing the brush head along the plurality of first texturing features, the plurality of second texturing features, or the plurality of third texturing features comprises applying pressure to the brush head as it is moved along a region of the device.

15. The method of claim 5, further comprising removing excess moisture from the brush head using the device.

16. The method of claim 5, wherein washing the brush head along the plurality of first texturing features comprises using the bristles to penetrate and wipe the brush head for removal of residue.

17. The method of claim 5, further comprising at least one of the texturing features being directionally neutral or balanced, and accommodating a circular or swirling motion of the brush head over the respective surface region.

18. A device for cleaning cosmetic brushes, the device comprising:

a main body section adapted to accommodate a palm and fingers of a user's hand;

first texturing features comprising a plurality of bristles formed over a first surface region of the device, each of the plurality of bristles being elongate in a height direction and having a height greater than a diameter thereof;

second texturing features comprising a plurality of nodules formed over a second surface region of the device, each of the plurality of nodules having a width at least as a great as a height thereof;

a directionally balanced arrangement of third texturing features distributed over a third surface region of the device that overlies a back of the user's hand or the palm when the device is worn on the user's hand, the third texturing features extending in the third surface region in at least two mutually perpendicular directions and adapted for swirling motion of the cosmetic brush head substantially equally in all directions along the medial surface region for washing the cosmetic brush head; and a cleaning solution applied to the device, wherein the brush head is penetrated with the cleaning solution;

wherein the diameter of the bristles is taken at the first surface region; and wherein the width of the nodules is taken at the second surface region.

19. The device of claim 18, wherein the device is adapted for cleaning cosmetic brushes used to apply facial makeup and for cleaning cosmetic brushes used to apply eye makeup.

20. A device for cleaning cosmetic brushes, the device comprising:

first texturing features comprising a plurality of bristles formed over a first surface region of the device, each of the plurality of bristles being elongate in a height direction and having a height greater than a diameter thereof;

second texturing features comprising a plurality of nodules formed over a second surface region of the device, each of the plurality of nodules having a width at least as a great as a height thereof; and third texturing features distributed over a third surface region of the device, the third texturing features extending in the third surface region in at least two mutually perpendicular directions;

wherein the diameter of the bristles is taken at the first surface region;

wherein the width of the nodules is taken at the second surface region; and wherein the second texturing features comprise a plurality of first and second nodules having respective first and second different sizes intermingled with one another.

* * * * *